US010524550B2

(12) United States Patent
Zhu et al.

(10) Patent No.: US 10,524,550 B2
(45) Date of Patent: Jan. 7, 2020

(54) UMBRELLA

(71) Applicant: Zhejiang Yotrio Group Co., Ltd., Linhai (CN)

(72) Inventors: Lei Zhu, Linhai (CN); Jianping Xie, Linhai (CN)

(73) Assignee: ZHEJIANG YOTRIO GROUP CO., LTD., Linhai (CN)

( * ) Notice: Subject to any disclaimer, the term of this patent is extended or adjusted under 35 U.S.C. 154(b) by 0 days.

(21) Appl. No.: 16/237,606

(22) Filed: Dec. 31, 2018

(65) Prior Publication Data

US 2019/0203502 A1 Jul. 4, 2019

(30) Foreign Application Priority Data

Dec. 29, 2017 (CN) ..... 2017 2 189876 U

(51) Int. Cl.

| | |
|---|---|
| ***A45B 25/18*** | (2006.01) |
| ***A45B 25/22*** | (2006.01) |
| ***A45B 23/00*** | (2006.01) |
| *A45B 19/00* | (2006.01) |

(52) U.S. Cl.

CPC ..... *A45B 25/18* (2013.01); *A45B 25/22* (2013.01); *A45B 23/00* (2013.01); *A45B 2019/004* (2013.01); *A45B 2025/186* (2013.01)

(58) Field of Classification Search

CPC ... A45B 25/18; A45B 2025/186; A45B 25/20; A45B 25/22

See application file for complete search history.

(56) References Cited

U.S. PATENT DOCUMENTS

| | | | | |
|---|---|---|---|---|
| 2,923,449 | A * | 2/1960 | Sund | D06F 57/04 135/15.1 |
| 3,850,187 | A * | 11/1974 | Haisler | A45B 11/00 135/25.3 |
| 6,089,244 | A * | 7/2000 | Ko | A45B 25/02 135/29 |
| 7,334,591 | B2 * | 2/2008 | Aloi | A45B 25/02 135/31 |
| 8,020,572 | B2 | 9/2011 | Ma | |
| 2008/0115815 | A1 * | 5/2008 | Awni | A45B 25/18 135/33.7 |

FOREIGN PATENT DOCUMENTS

| | | | | |
|---|---|---|---|---|
| DE | 102017108227 | A1 * | 10/2018 | A45B 11/00 |

* cited by examiner

*Primary Examiner* — David R Dunn
*Assistant Examiner* — Danielle Jackson
(74) *Attorney, Agent, or Firm* — Schwegman Lundberg & Woessner, P.A.

(57) ABSTRACT

This application provides an umbrella including an umbrella frame, supporting members, rotating shafts, fixing members, and umbrella surfaces. The umbrella surfaces are installed at the umbrella frame through connections of the supporting members and the fixing members so as to form a layered structure with a beautiful appearance and good breathability and ventilation. Each of the supporting members has installation arms which can be directly installed at the umbrella rib through the rotating shaft. Each of the supporting members has a first supporting surface and a second supporting surface cooperating with the umbrella rib to achieve limitation, which can limit a rotation range of the supporting members and reduce members such as a bracket, a spring and so on. The structure is simpler, and the assembly is very convenient.

8 Claims, 4 Drawing Sheets

UMBRELLA

CROSS-REFERENCE TO RELATED APPLICATIONS

This Non-provisional application claims priority under 35 U.S.C. § 119(a) on Chinese Patent Application No(s). 201721898762.3 filed on Dec. 29, 2017, the entire contents of which are hereby incorporated by reference.

BACKGROUND OF THE INVENTION

Field of the Invention

This invention relates to a technical field of an umbrella and, more particularly, to an umbrella having a plurality of umbrella surfaces.

Description of the Related Art

A U.S. Pat. No. 8,020,572B2 discloses an umbrella having a plurality of umbrella panels. Gaps are formed between of the several umbrella panels, which can permit air to be vented and make the appearance beautiful. This umbrella is very popular among consumers. However, the spacer assemblies, which separate the several umbrella panels in this patent, include many members such as a bracket, a resilient member (e.g. spring), an elongate member and so on. The structure is complex, and the assembly is inconvenient.

BRIEF SUMMARY OF THE INVENTION

To improve the prior art, this invention provides an umbrella to overcome at least one of the above-mentioned deficiencies.

A technical solution adopted by this invention is as follows.

An umbrella includes an umbrella frame, supporting members, rotating shafts, fixing members, and umbrella surfaces;

the umbrella frame includes a plurality of umbrella ribs and an umbrella shaft, and one end of each of the umbrella ribs is pivotally connected with one end of the umbrella shaft;

supporting members are rotatably installed at the umbrella ribs, each of the supporting members has a fixing end connected with a corresponding umbrella rib and an installing end away from the fixing end, the installing end of the supporting member is configured to connect a corresponding umbrella surface, and the corresponding umbrella surface drives the installing end of the supporting member to rotate;

each of the fixing members has a first end connected with the corresponding umbrella rib and a second end away from the first end, a gap is formed between the second end of the fixing member and the corresponding umbrella rib, and the second end of the fixing member is configured to connect the corresponding umbrella surface; and each of the umbrella surfaces has a higher end connected with the fixing member and a lower end connected with the supporting member;

wherein the installing end of each supporting member has two opposite installation arms, the corresponding umbrella rib is stuck between the two installation arms, each of the installation arms is provided with an installation hole, and the rotating shaft passes through the installation holes and the corresponding umbrella rib to install the supporting member at the corresponding umbrella rib; and each of the supporting members has a first supporting surface and a second supporting surface cooperating with the corresponding umbrella rib to achieve limitation, and the first supporting surface and the second supporting surface face toward two ends of the corresponding umbrella rib, respectively; when the umbrella surfaces are tensioned, the first supporting surfaces contact the umbrella ribs; and when the umbrella surfaces are loosened, the second supporting surfaces contact the umbrella ribs.

In one embodiment of this invention, an angle between the first supporting surface and the second supporting surface may be an obtuse angle.

In one embodiment of this invention, each of the supporting members may be a hollow structure including a shell and a limiting rib. The limiting rib may be disposed inside the shell and connected with the shell, the limiting rib may be located between two installation arms, and the first supporting surface of the supporting member and the second supporting surface of the supporting member may be located on the limiting rib.

In one embodiment of this invention, each of the supporting members may further include a strengthening rib connected with the shell and the limiting rib.

In one embodiment of this invention, each of the supporting members may further include a strengthening rib connected with the shell.

In one embodiment of this invention, the installing end of each supporting member and the fixing end of each supporting member may be connected through a bend.

In one embodiment of this invention, each fixing member may be a sheet-shaped structure, and a bending portion may be arranged between the first end of each fixing member and the second end of each fixing member, such that the second end and the corresponding umbrella rib may be spaced apart to form the gap when the first end is installed at the corresponding umbrella rib.

In one embodiment of this invention, a shape of the first end of each fixing member may be adapted to a shape of the corresponding umbrella rib, and the second end of each fixing member may face toward the installing end of each supporting member.

In one embodiment of this invention, a width of each fixing member may gradually decrease from the bending portion to the first end.

Compared with the prior art, beneficial effects of this invention are as follows.

The umbrella surfaces are installed at the umbrella frame through connections of the supporting members and the fixing members so as to form a layered structure with a beautiful appearance and good breathability and ventilation. Each of the supporting members has installation arms which can be directly installed at the corresponding umbrella rib through the rotating shaft. Each of the supporting members has a first supporting surface and a second supporting surface cooperating with the umbrella rib to achieve limitation, which can limit a rotation range of the supporting members and reduce members such as a bracket, a spring and so on. The structure is simpler, and the assembly is very convenient.

DETAILED DESCRIPTION OF THE INVENTION

Figure 1:
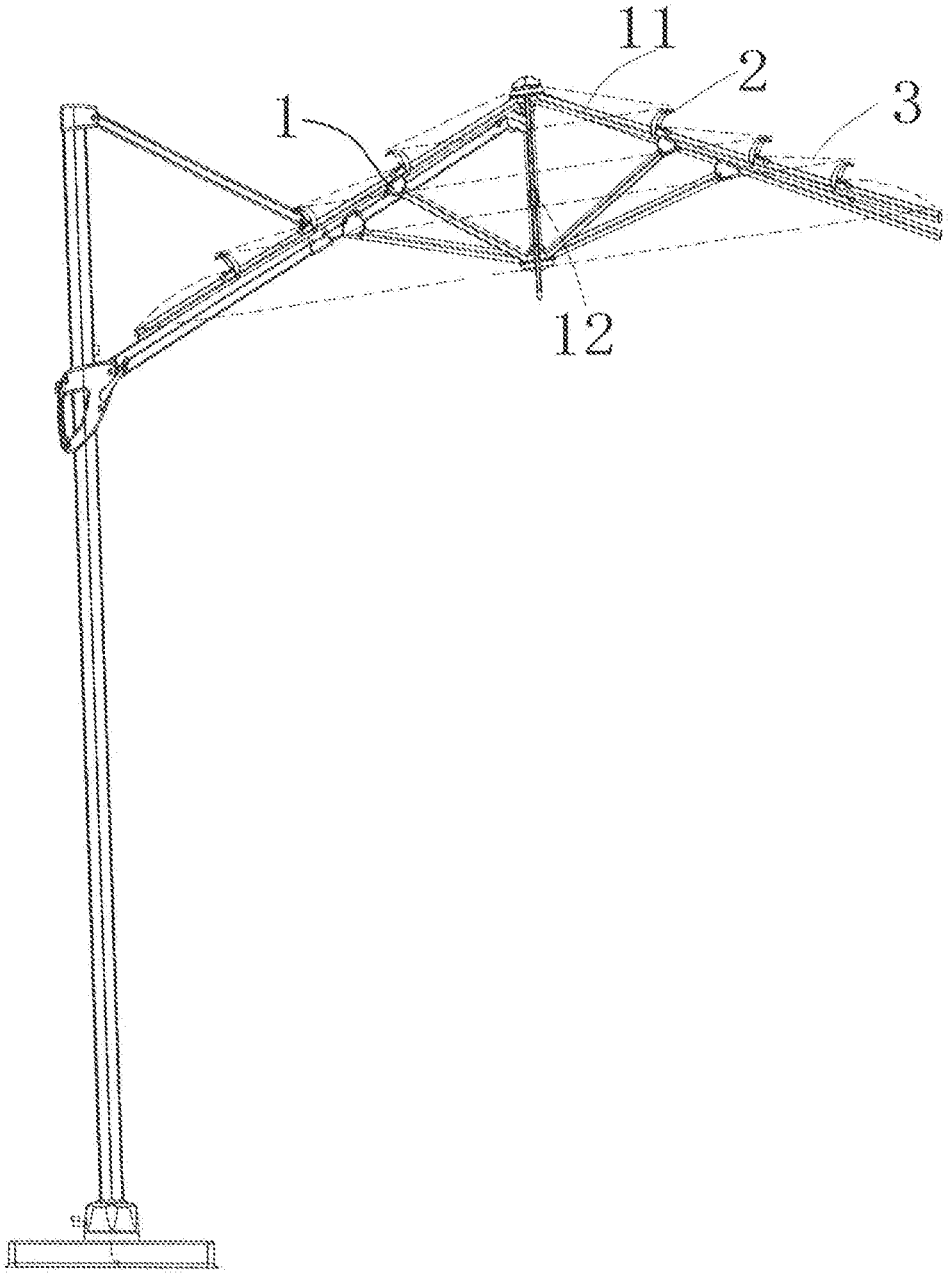
FIG. 1 is a structural schematic view of an umbrella according to one embodiment of this invention.

This invention will be described in detail below with reference to the accompanying drawings.

Please refer to FIG. 1-FIG. 5. This invention provides an umbrella, including an umbrella frame 1, a plurality of umbrella surfaces 3, a plurality of supporting members 2, and a plurality of fixing members 4.

The umbrella frame 1 includes a plurality of umbrella ribs 11 and an umbrella shaft 12. One end of each of the umbrella ribs 11 is pivotally connected with one end of the umbrella shaft 12. A plurality of umbrella ribs 11 can be rotated relative to the umbrella shaft 12 thus to open or close the whole umbrella frame 1.

The supporting members 2 are rotatably installed at the umbrella ribs 11, and each of the supporting members 2 has a fixing end 21 connected with a corresponding umbrella rib 11 and an installing end 22 away from the fixing end 21. The installing end 22 of the supporting member 2 is configured to connect a corresponding umbrella surface 3. The umbrella surfaces 3 are tensioned or loosened thus to drive the installing ends 22 of the supporting members 2 to rotate. The umbrella surfaces 3 can be sewn with straps, and the straps can be tied at the installing ends 22 of the supporting members 2. The straps can be annular straps, and the straps can also have certain elasticity, which is not limited in this invention.

The fixing members 4 are fixed at umbrella ribs 11. Each of the fixing members 4 has a first end 41 connected with the corresponding umbrella rib 11 and a second end 42 away from the first end 41, a gap 401 is formed between the second end 42 of the fixing member 4 and the umbrella rib 11, and the second end 42 of the fixing member 4 is configured to connect the corresponding umbrella surface 3.

Figure 6:
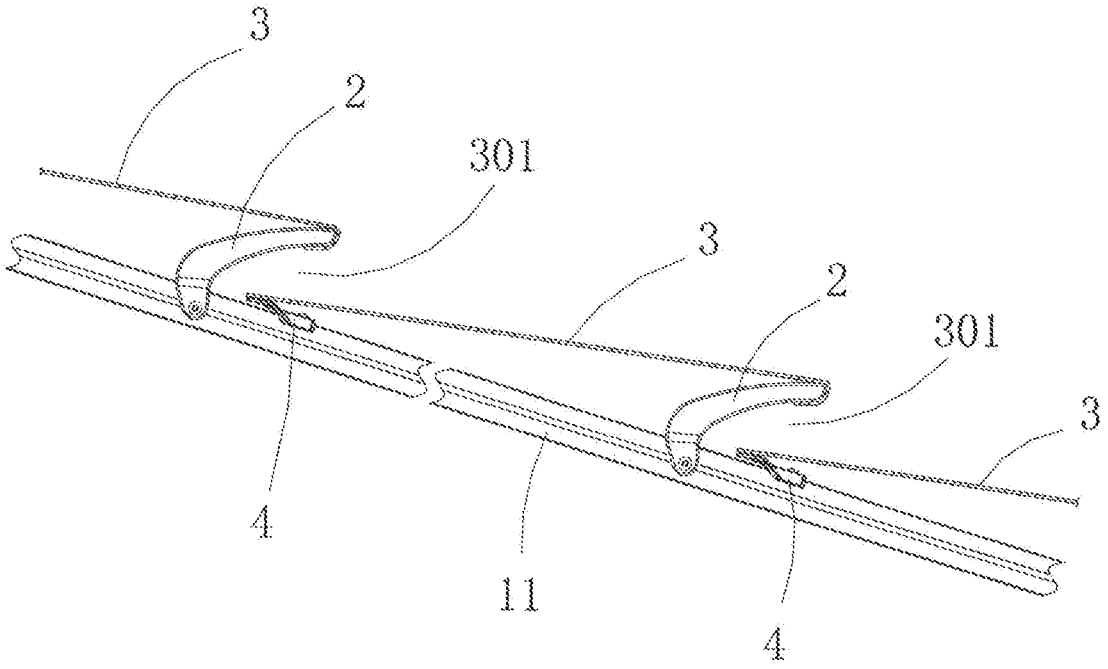
FIG. 6 is a partial cross-section view of the umbrella when umbrella surfaces are in a tensioned state according to this invention.

Please refer to FIG. 1. In one embodiment, the number of the umbrella surfaces 3 is four. A higher end of the umbrella surface 3 at the top of the umbrella is connected with the top of the umbrella ribs 11, and a lower end of the umbrella surface 3 at the top of the umbrella is connected with the supporting members 2. A higher end of the umbrella surface 3 at the bottom of the umbrella is connected with the fixing members 4, and a lower end of the umbrella surface 3 at the bottom of the umbrella is connected with the bottom of the umbrella ribs 11. A higher end of the umbrella surface 3 in the middle of the umbrella is connected with the fixing members 4, and a lower end of the umbrella surface 3 in the middle of the umbrella is connected with the supporting members 2. Therefore, the umbrella has a layered structure, and air flow gaps 301 (as shown in FIG. 6) are formed between different umbrella surfaces 3 to permit air to flow across, such that the umbrella has a good breathability, ventilation and beautiful appearance. This invention does not limit the number of the umbrella surfaces 3.

Each of the umbrella ribs 11 is provided with a plurality of supporting members 2 and a plurality of fixing members 4, and the number of the supporting members 2 corresponds to the number of the fixing members 4. The fixing members 4 are entirely located below the support members 2, and a lower end of the umbrella surface 3 located above can overlap/shield a higher end of the lower umbrella surface 3 such that light and rain cannot penetrate through the air flow gaps 301 among the umbrella surfaces 3 when the umbrella is used to shield the light or the rain, which ensures a shielding effect of the umbrella surfaces 3.

The installing end 22 of the supporting member 2 has two oppositely disposed installation arms 20, and an umbrella rib 11 is stuck between the two installation arms 20. Each of the installation arms 20 is provided with an installation hole 23, a rotating shaft 25 passes through the installation holes 23 and the umbrella rib 11 to install the supporting member 2 on the umbrella rib 11, and the supporting member 2 can be rotated relative to the umbrella rib 11. This structure is very simple and easy to be installed. The rotating shaft 25 can be a commonly used fastener such as a screw, a rivet and so on.

Figure 2:
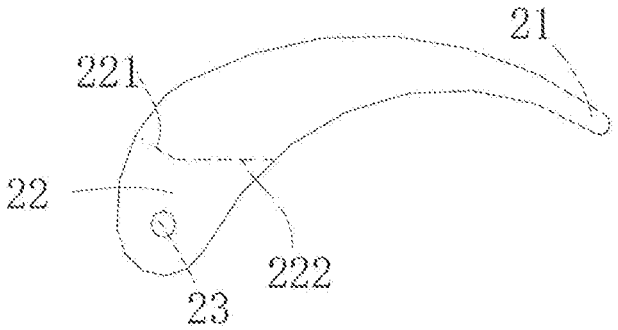
FIG. 2 is a structural schematic view of a supporting member of the umbrella according to one embodiment of this invention.
Figure 3:
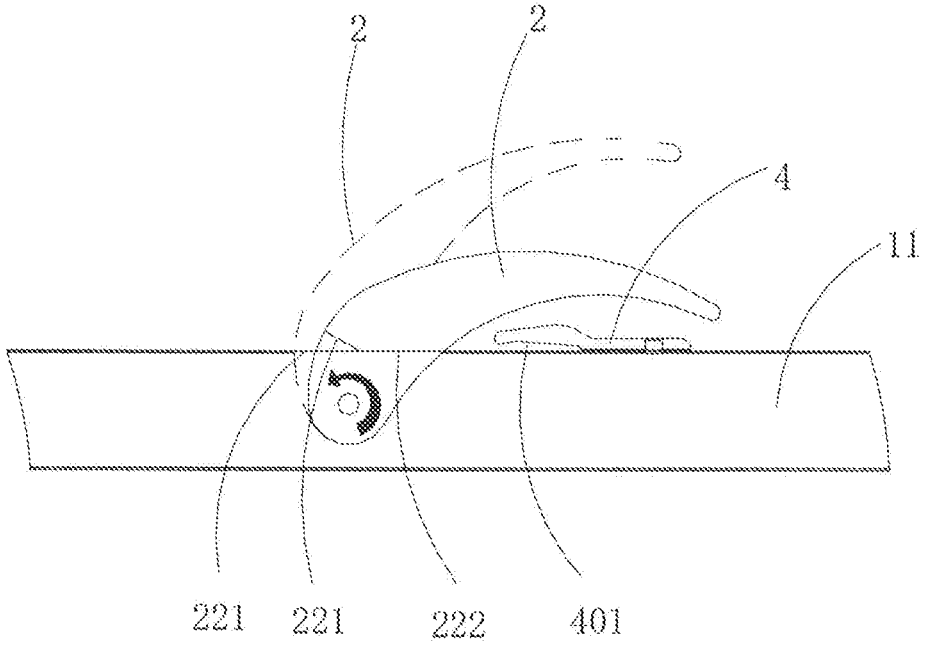
FIG. 3 is a schematic view of the supporting member in a rotation state according to this invention.
Figure 7:
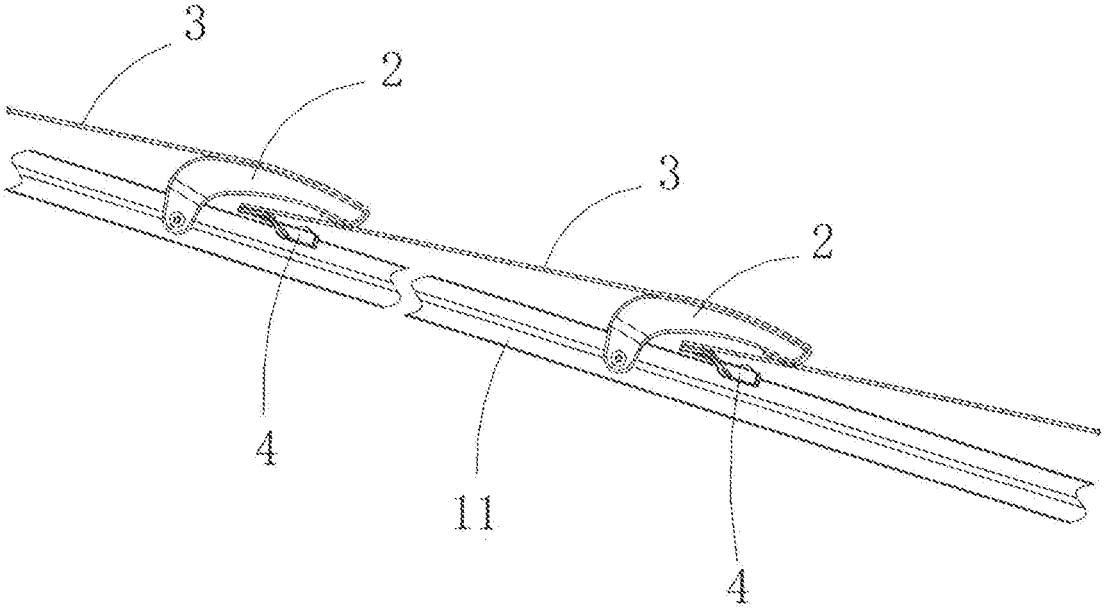
FIG. 7 is a partial cross-section view of the umbrella when the umbrella surfaces are in a loosened state according to this invention.

Please refer to FIG. 2 and FIG. 3. Each of the supporting members 2 has a first supporting surface 221 and a second supporting surface 222 cooperating with the corresponding umbrella rib 11 to achieve limitation, and the first supporting surface 221 and the second supporting surface 222 face toward two ends of the umbrella rib 11, respectively. Please refer to FIG. 3. A dashed line indicates a state in which the first supporting surface 221 of the supporting member 2 contacts the umbrella rib 11, and a solid line indicates a state in which the second supporting surface 222 of the supporting member 2 contacts the umbrella rib 11. When the entire umbrella frame 1 is opened, the umbrella surfaces 3 are stretched from a loosened state to a tensioned state, the supporting members 2 are rotated to a position in which the first supporting surfaces 221 contact outer surfaces of the umbrella ribs 11, and the supporting members 2 cannot continue to rotate due to a limitation effect of the first supporting surfaces 221, such that the umbrella surfaces 3 is kept in the tensioned state, as shown in FIG. 6; and when the entire umbrella frame 1 is closed, the umbrella surfaces 3 are closed from the tensioned state to the loosened state, and the supporting members 2 are rotated toward another direction such that the second supporting surfaces 222 contact the umbrella ribs 11, as shown in FIG. 7. At this time, an angle between the supporting member 2 and the umbrella rib 11 is relatively small, which is convenient for the umbrella to be closed and stored.

The first supporting surface 221 and the second supporting surface 222 limit a rotation range of the supporting member 2, and an angle between the first supporting surface 221 and the second supporting surface 222 is an obtuse angle.

Figure 4:
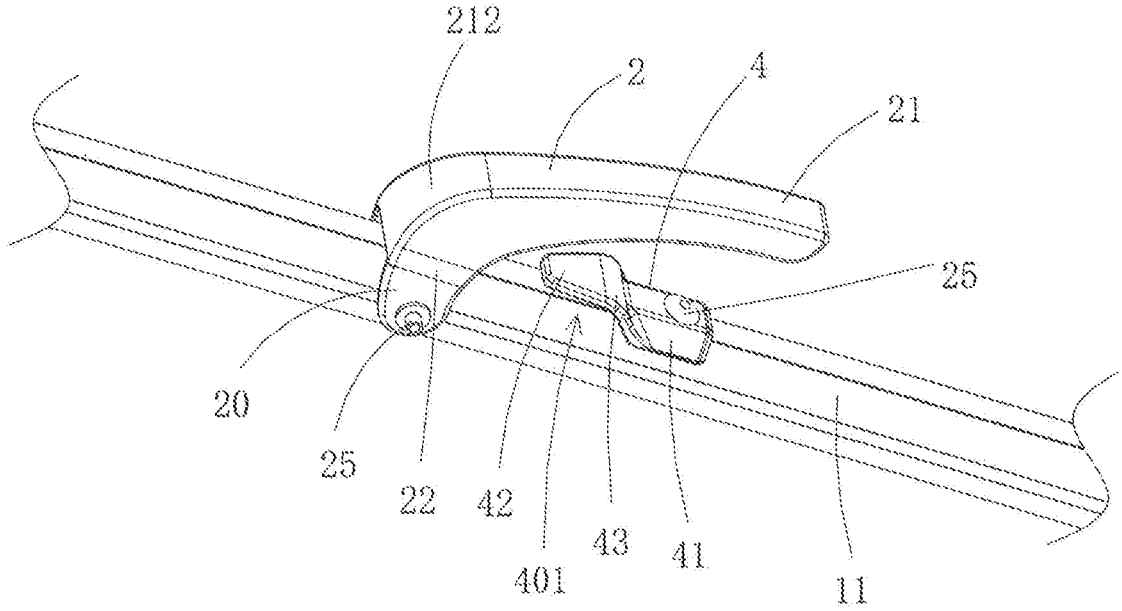
FIG. 4 is a schematic view of the supporting member and a fixing member in an assembly state according to this invention.
Figure 5:
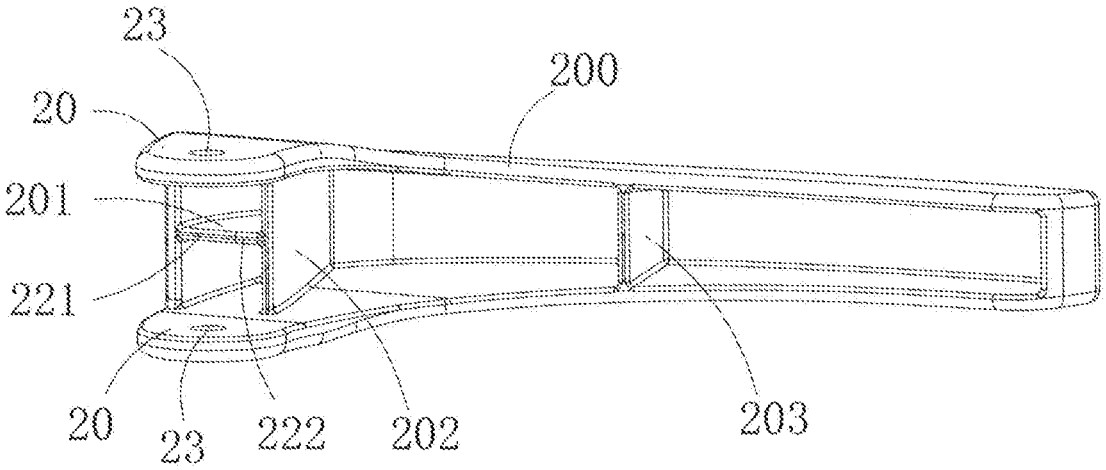
FIG. 5 is a three dimensional diagram of the supporting member according to one embodiment of this invention.

Please refer to FIG. 4 and FIG. 5. The supporting member 2 is a hollow structure including a shell 200 and a limiting rib 201. The limiting rib 201 is disposed inside the shell 200 and is connected with the shell 200, the limiting rib 201 is located between two installation arms 20, and the first supporting surface 221 of the supporting member 2 and the second supporting surface 222 of the supporting member 2 are located on the limiting rib 201. This structural design makes the whole supporting member 2 relatively light and saves materials.

Further, the supporting member 2 further includes strengthening ribs 202 and 203, the strengthening rib 202 is connected with the shell 200 and the limiting rib 201, and the strengthening rib 203 is connected with the shell 200. The overall structural strength of the supporting member 2 can be strengthened by disposing strengthening ribs 202 and 203.

Please refer to FIG. 4. The installing end 22 of the support member 2 and the fixing end 21 of the support member 2 are connected through a bend 212, which ensures that there is enough space between the support member 2 and the umbrella rib 11 when the support member 2 is rotated, and also ensures that the appearance is beautiful.

Please refer to FIG. 4. The fixing member 4 is a sheet-shaped structure, and a bending portion 43 is arranged between the first end 41 of the fixing member 4 and the second end 42 of the fixing member 4, such that the second end 42 and the umbrella rib 11 are spaced apart to form the gap 401 when the first end 41 is installed at the umbrella rib 11. The fixing member 4 is installed at the umbrella rib 11 through the screw or the rivet 40, and the shape of the first end 41 of the fixing member 4 is adapted to the shape of the umbrella rib 11, such that the fixing member 4 can be more closely attached to the umbrella rib 11 which is more stable after installation. The second end 42 of the fixing member 4 faces toward the installing end 22 of the supporting member 2. When the umbrella surfaces 3 are assembled, only the umbrella surfaces 3 need to be hung at the second ends 42 of the fixing members 4, which is very convenient. The width of the fixing member 4 gradually decreases from the bending portion 43 to the first end 41, such that the first end 41 of the fixing member 4 is connected with the umbrella surface 3 more conveniently.

Although this invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above

What is claimed is:

1. An umbrella, comprising: an umbrella frame, supporting members, rotating shafts, fixing members, and umbrella surfaces;

the umbrella frame, comprising a plurality of umbrella ribs and an umbrella shaft, wherein one end of each of the umbrella ribs is pivotally connected with one end of the umbrella shaft;

wherein the supporting members are rotatably installed at the umbrella ribs, wherein each of the supporting members has a fixing end connected with a corresponding umbrella surface and an installing end away from the fixing end, the installing end of the supporting member is configured to connect a corresponding umbrella rib, and the corresponding umbrella surface drives the installing end of the supporting member to rotate;

wherein each of the fixing members has a first end connected with the corresponding umbrella rib and a second end away from the first end, a gap is formed between the second end of the fixing member and the corresponding umbrella rib, and the second end of the fixing member is configured to connect the corresponding umbrella surface; and wherein each of the umbrella surfaces has a higher end connected with the fixing members and a lower end connected with the supporting members;

wherein the installing end of each supporting member has two opposite installation arms, the corresponding umbrella rib is stuck between the two installation arms, each of the installation arms is provided with an installation hole, and one of the rotating shafts passes through the installation holes and the corresponding umbrella rib to install the supporting member at the corresponding umbrella rib; and each of the supporting members has a first supporting surface and a second supporting surface cooperating with the corresponding umbrella rib to achieve limitation, the first supporting surface faces toward one end of the corresponding umbrella rib, and the second supporting surface faces toward the other end of the corresponding umbrella rib; when the umbrella surfaces are tensioned, the first supporting surfaces contact the umbrella ribs; and when the umbrella surfaces are loosened, the second supporting surfaces contact the umbrella rib;

wherein each of the supporting members is a hollow structure comprising a shell and a limiting rib, the limiting rib is disposed inside the shell and is connected with the shell, the limiting rib is located between the two installation arms, and the first supporting surface of the supporting member and the second supporting surface of the supporting member are located on the limiting rib.

2. The umbrella according to claim 1, wherein an angle between the first supporting surface and the second supporting surface is an obtuse angle.

3. The umbrella according to claim 1, wherein each of the supporting members further comprises a strengthening rib connected with the shell and the limiting rib.

4. The umbrella according to claim 1, wherein each of the supporting members further comprises a strengthening rib connected with the shell.

5. The umbrella according to claim 1, wherein the installing end of each supporting member and the fixing end of each supporting member are connected through a bend.

6. The umbrella according to claim 1, wherein each fixing member is a sheet-shaped structure, and a bending portion is arranged between the first end of each fixing member and the second end of each fixing member, such that the second end and the corresponding umbrella rib are spaced apart to form the gap when the first end is installed at the corresponding umbrella rib.

7. The umbrella according to claim 6, wherein a shape of the first end of each fixing member is adapted to a shape of the corresponding umbrella rib, and the second end of each fixing member faces toward the installing end of each supporting member.

8. The umbrella according to claim 6, wherein a width of each fixing member gradually decreases from the bending portion to the second end.

* * * * *